US007357757B2

(12) United States Patent
Brown

(10) Patent No.: US 7,357,757 B2
(45) Date of Patent: Apr. 15, 2008

(54) SELF-REGULATING ENDLESS CLIMBING WALL

(76) Inventor: George T. Brown, 408 N. Findlay, Haskins, OH (US) 43525

( * ) Notice: Subject to any disclaimer, the term of this patent is extended or adjusted under 35 U.S.C. 154(b) by 0 days.

(21) Appl. No.: 11/611,525

(22) Filed: Dec. 15, 2006

(65) Prior Publication Data

US 2007/0142176 A1 Jun. 21, 2007

Related U.S. Application Data

(60) Provisional application No. 60/597,676, filed on Dec. 16, 2005.

(51) Int. Cl.
*A63B 7/04* (2006.01)
*A63B 9/00* (2006.01)

(52) U.S. Cl. ..... 482/37; 482/8; 482/51; 198/850

(58) Field of Classification Search ..... 482/1–9, 482/35–37, 51–54, 57, 148, 900–902; 198/850
See application file for complete search history.

(56) References Cited

U.S. PATENT DOCUMENTS 5,125,877 A 6/1992 Brewer
5,328,422 A 7/1994 Nichols
5,352,166 A * 10/1994 Chang ..... 482/52
6,231,482 B1 * 5/2001 Thompson ..... 482/37
6,860,836 B1 * 3/2005 Wu ..... 482/37
7,195,582 B2 * 3/2007 Wu ..... 482/37

* cited by examiner

*Primary Examiner*—Glenn Richma

(57) ABSTRACT

An improved simulated climbing wall provides a self-regulating endless climbing surface. The structure includes a form including upper and lower at least partially cylindrical outer surfaces, a planar forward surface, and an open back surface. A continuous belt includes an inner surface and an outer surface. The inner surface is disposed in sliding engagement with the cylindrical surfaces and planar forward surface of the form, and the outer surface of the belt includes a plurality of raised features configured for climbing by a user. A tensioning shoe engages with the inner surface of the belt through the open back surface of the form, and a mechanism, coupled to the tensioning shoe, is operative to a) relieve tension on the belt as a user climbs upwardly, thereby increasing rotational slippage of the belt around the form, and b) increase tension on the belt as a user moves downwardly, thereby reducing or terminating rotational slippage of the belt around the form. In the preferred embodiment, a pair of pivoting levers are provided, each having one end coupled to a climber and a second end coupled to the tensioning shoe such that, as a climber ascends the belt, the levers are raised, reducing the frictional engagement of the inner surface of the belt against the form, and as a climber moves downwardly on the belt, the levers are lowered, increasing the frictional engagement of the inner surface of the belt against the form.

8 Claims, 4 Drawing Sheets

SELF-REGULATING ENDLESS CLIMBING WALL

REFERENCE TO RELATED APPLICATION

This application claims priority from U.S. Provisional Patent Application Ser. No. 60/597,676, filed Dec. 16, 2005, the entire content of which is incorporated herein by reference.

FIELD OF THE INVENTION

This invention relates generally to exercise equipment and, in particular, to a simulated climbing wall having a self-adjustment mechanism.

BACKGROUND OF THE INVENTION

Many exercise and recreational centers are now equipped with simulated climbing walls. Devices of this type include both larger, stationary structures as well as more compact "endless walls." Conventional endless wall climbers consist of large linked panels dressed over upper and lower rollers. The panels have an outer surface with hand-holds or other features that a user 'climbs' as the panels rotate.

A drawback of typical linked-panel type climbers is that the rollers are motor-driven, resulting in a piece of equipment which is heavy and expensive to purchase and operate. As such, there have been attempts to provide non-motorized, self-regulating machines. One such piece of equipment is disclosed in U.S. Pat. No. 5,125,877 entitled "Simulated Climbing Wall." This prior-art unit is comprised of a frame, at least two guide members rotatably attached at the top of the frame, and a plurality of climbing wall panels, each being flexibly attached to the next in a continuous chain. The chain structure is adjustable such that the panels may be moved downwardly in a controlled manner as the climber climbs.

In operation, the apparatus of the '877 patent uses an automotive rear axle assembly differential unit including two wheels and brakes. The wheels support the weight of the articulated wall structure and allow the articulated wall structure to move down under the weight of the climber, when the brakes are released. The brakes are normally on and are released when the climber passes a predetermined height on the wall. When the climber passes the predetermined height, a rope attached to the climber's waist through a carabineer becomes taut and lifts a weight, thereby releasing the brake and allowing the panels to move downwardly under the weight of the climber. When the user descends to a sufficient level, the brakes once again engage, allowing the user to ascend the wall.

Another self-regulating device is disclosed in U.S. Pat. No. 5,328,422, entitled "Ladder-Climbing Exercise Device." This system includes an inclined flight along which a plurality of rungs are presented in an endless manner. The marginal ends of the rungs are mounted on endless chains which are supported by a frame. The chains are coupled to a fan having a squirrel cage-like rotor. The position of an operator relative to the flight changes the size of a fan aperture to vary the resistance afforded by the device to the climbing motion.

Although these and other prior-art systems attempt to regulate climbing motion without the use of electricity, there nevertheless remain heavy and/or complex. The need therefore remains for a simple, elegant and effective self-regulating endless wall-climbing structure.

SUMMARY OF THE INVENTION

This invention improves upon existing simulated climbing walls by providing a self-regulating endless climbing wall. The system comprises a form including upper and lower at least partially cylindrical outer surfaces, a planar forward surface, and an open back surface. A continuous belt includes an inner surface and an outer surface. The inner surface is disposed in sliding engagement with the cylindrical surfaces and planar forward surface of the form, and the outer surface of the belt includes a plurality of raised features configured for climbing by a user.

A tensioning shoe engages with the inner surface of the belt through the open back surface of the form, and a mechanism, coupled to the tensioning shoe, is operative to a) relieve tension on the belt as a user climbs upwardly, thereby increasing rotational slippage of the belt around the form, and b) increase tension on the belt as a user moves downwardly, thereby reducing or terminating rotational slippage of the belt around the form.

In the preferred embodiment, the tensioning shoe is a generally horizontal bar having a lengthwise convex surface urged against the inner surface of the belt. A pair of pivoting levers are provided, each having one end coupled to a climber and a second end coupled to the tensioning shoe such that, as a climber ascends the belt, the levers are raised, reducing the frictional engagement of the inner surface of the belt against the form, and as a climber moves downwardly on the belt, the levers are lowered, increasing the frictional engagement of the inner surface of the belt against the form.

In an alternative embodiment, the apparatus a stationary frame and a tilting frame upon which the belt is disposed. In this case, the tensioning shoe is supported between the stationary frame and the tilting frame such that the tension of the belt around the form is reduced as a user climbs upwardly and increased as a user moves downwardly.

DETAILED DESCRIPTION OF INVENTION

Figure 1:
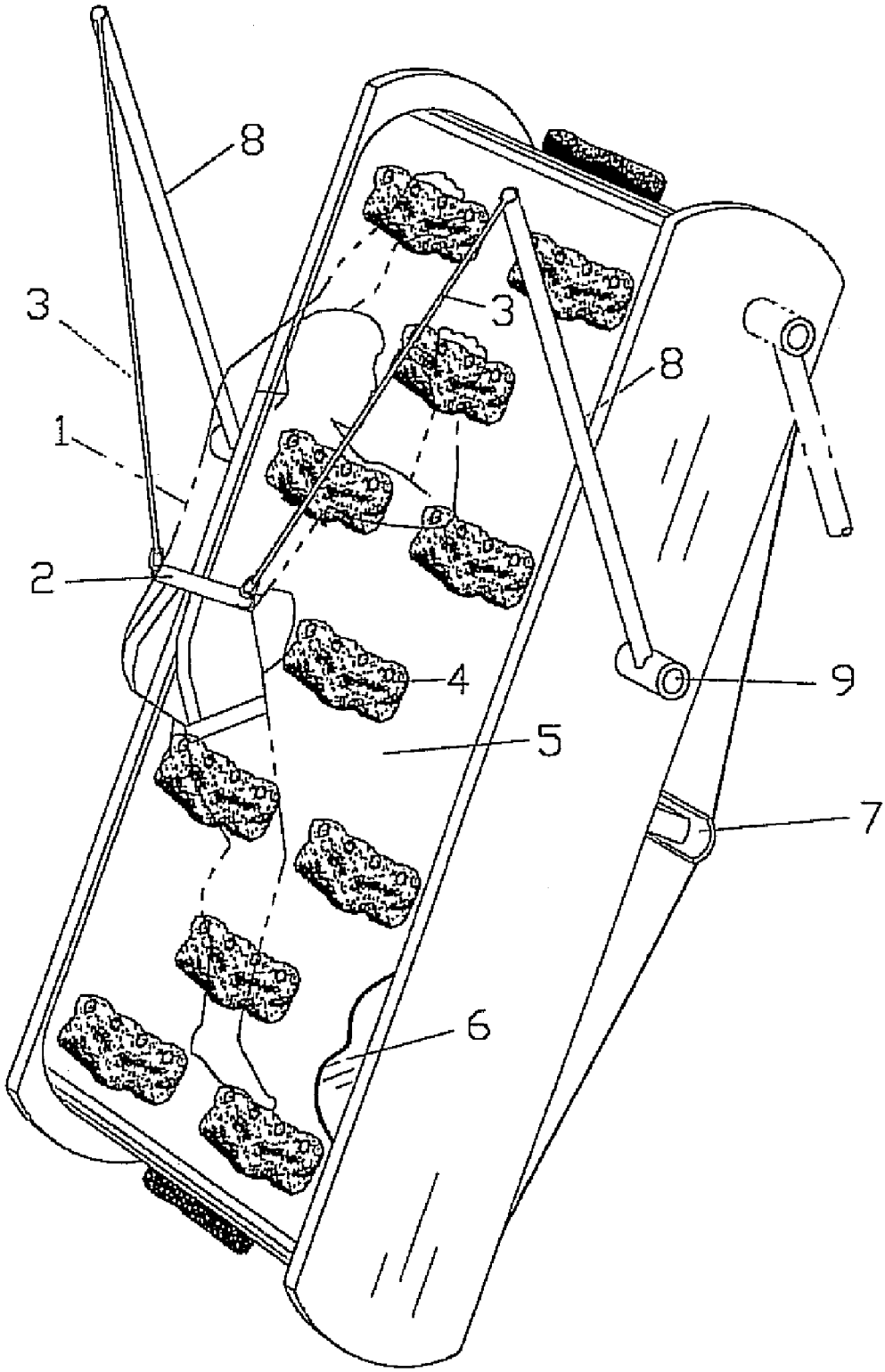
FIG. 1 is a drawing of the preferred embodiment of the invention seen from an oblique perspective.
Figure 2:
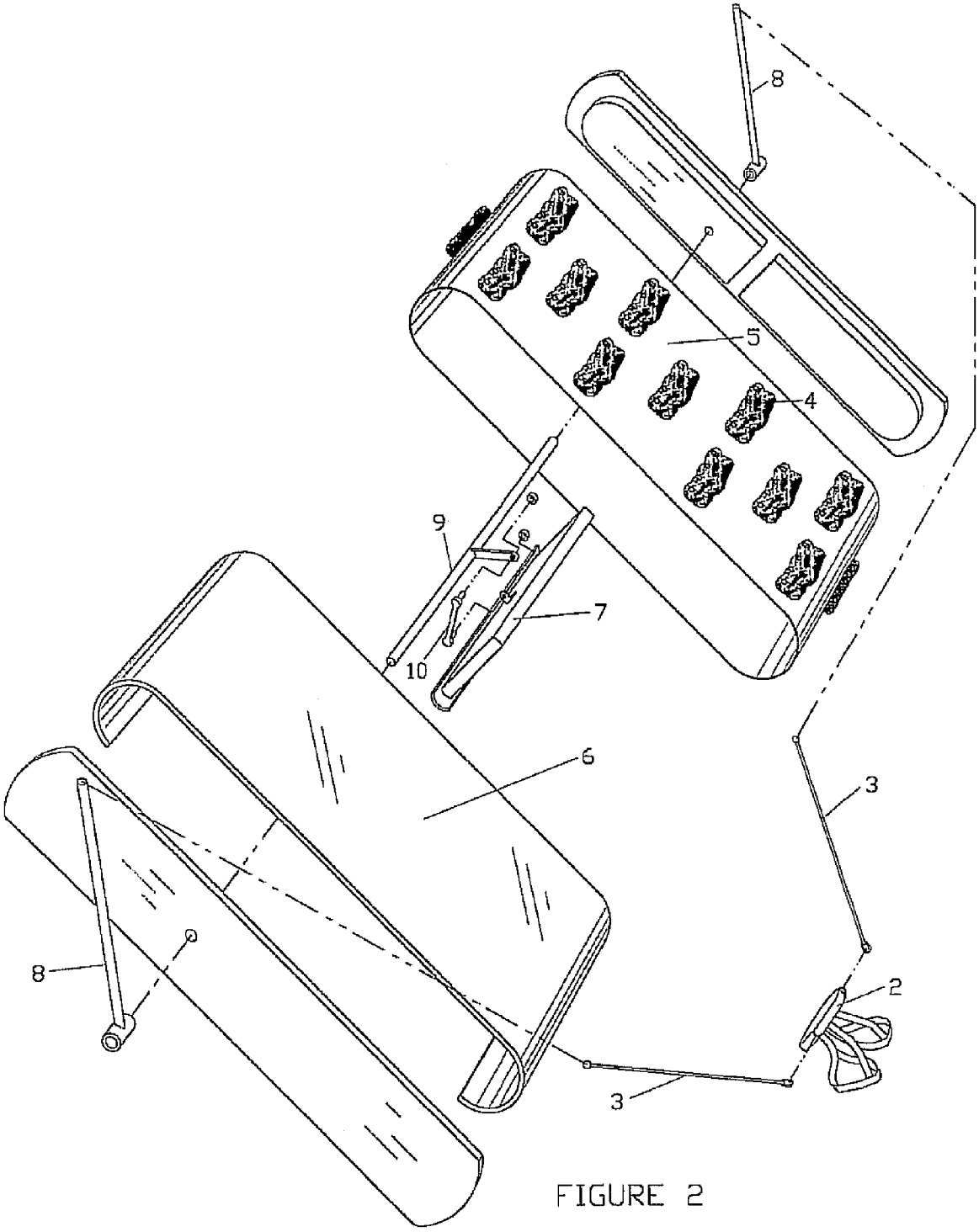
FIG. 2 is an exploded view of the preferred embodiment.
Figure 3:
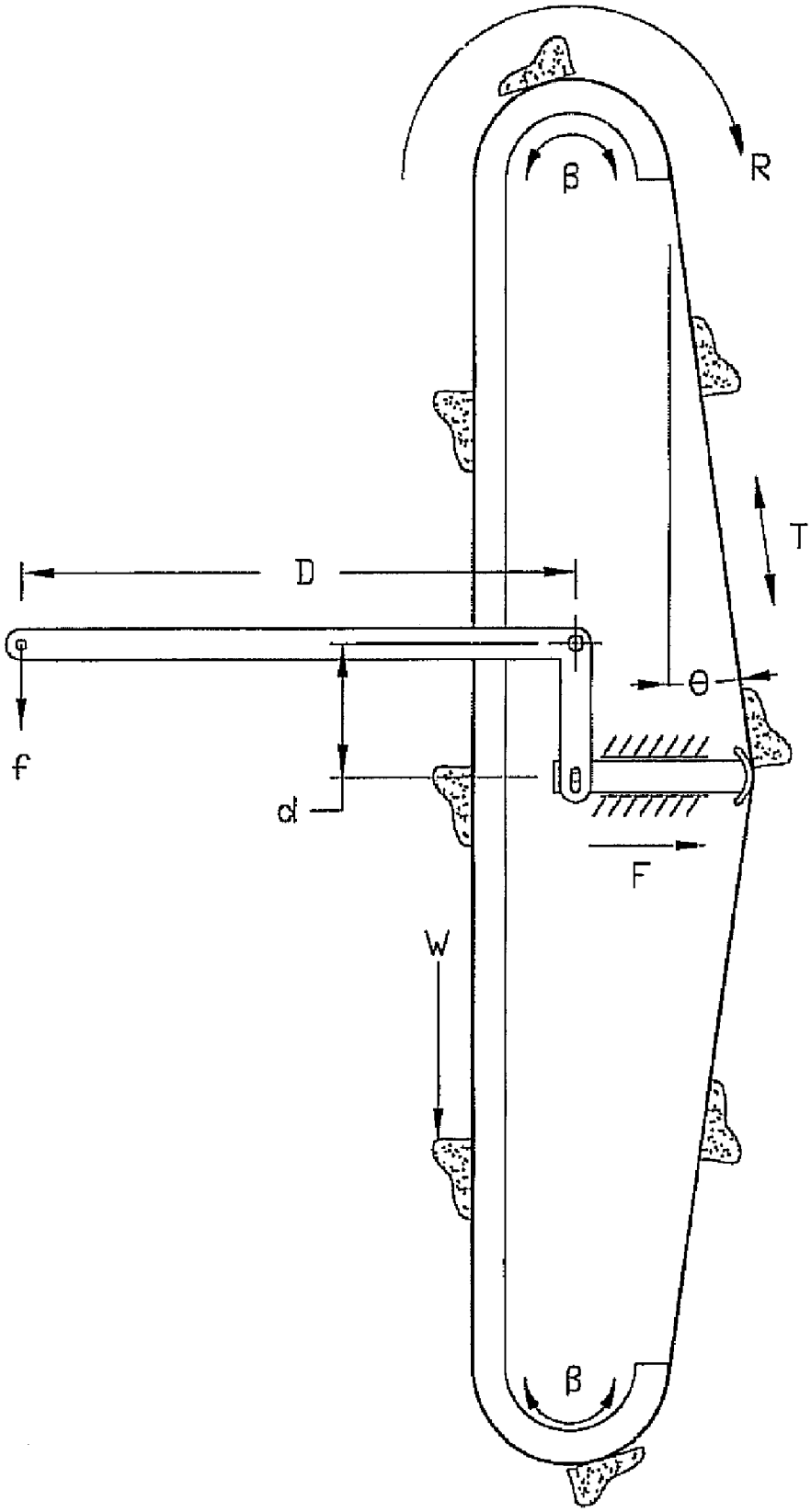
FIG. 3 is a side view of the preferred embodiment showing geometrical relationships.

Referring now to the drawings, FIGS. 1, 2 and 3 illustrate the preferred embodiment of the invention. FIG. 1 shows the invention assembled with the climber in position on a climbing surface, and with support frame portions removed for enhanced clarity. FIG. 2 is an exploded view of the preferred embodiment; and FIG. 3 shows geometrical and mathematical relationships associated with the belt-tensioning system.

The unit comprises a continuous belt 5 having an outer surface with the exposed hand and foot holds 4, and an inner surface against which a tensioning shoe 7 is used to adjust the tension of the belt and, hence, frictional contact between the belt and the form. The invention is not limited in terms of the type, style or number of hand/foot holds 4, and may use any protruding features as desired or required. Indeed, the belt may be provided with mounting holes or grommets so that different holds can be fastened in a variety of arrangements. The belt could also have a series of large holes for climbing hand holds.

As best seen in FIG. 2, the belt 5 extends around a form 6, such that the surface against which a climber engages remains substantially flat during use. The backside of the form 6 is open, however, to facilitate operation of the tensioning shoe as described elsewhere herein. In terms of materials, the belt 5 may be constructed of any suitable flexible material or structure, including rubber, polymeric materials, or interconnected horizontal rigid or semi-rigid slats. Indeed, the flexible belt could be constructed of rope like a rope ladder. The form 6 may also be constructed of any suitable material, including metals such as stainless steel, polymerics such as vinyl or polyethylene, and so forth, so long as smooth cooperation is achieved with the belt 5 during use. Although a continuous form 6 is shown, the invention does not preclude the use of upper and lower rollers in conjunction with a solid panel behind the forward surface of the belt.

The support leg system may be adjusted to hold the belt in any convenient orientation from true vertical to radical angles forward and back. That is, the angle may be changed to accomodate overclimbing and underclimbing. The support system may be anchored to the ceiling, wall or floor, and may be designed similar to a folding table or ladder supports. In terms of dimensions, the belt may be as narrow or as wide as practical depending upon the application. The height of the belt may range from 6 feet or greater, preferably less that 8 feet to accommodate common interior residential usage.

In the preferred embodiment, the tensioning shoe 7 is operated by a mechanism coupled to the climber through lever arms 8 attached to a shaft 9 which, in turn, is coupled to the tensioning shoe 7 through a linkage 10. The lever arms 8 are coupled to the user through cords 3, which may be elastic, attached to the user through climbing harness 2. A jointed or flexible arm could be used to connect climber to device to activate brake. Although two lever arms 8 and two cords 3 are illustrated, an alternative configuration may be achieved with a single lever arm and cord. Additionally, although the coupling to the climber is carried out through the harness shown, any other attachment means, such as chest, shoulder, waist belts, and so forth, may alternatively be used.

As perhaps best seen in FIG. 3, as the user climbs toward the upper portion of the unit, the tensioning shoe 7 is moved away from the inner surface of the belt 5, allowing more slippage to occur. As the user moves down to the lower portion of the belt 5, lever arms move down in conjunction with the climber, urging the tensioning shoe 7 against the inner surface of the belt 5, thereby decreasing slippage. This process repeats in a self-regulating manner, allowing the user to climb at a desired pace, with the tensioning shoe encouraging and discouraging rotation of the belt 5 as the user climbs, A belt pre-tensioning device may be used to set the device to different weights of climbers. A speed retarder or governor may also be provided, which could contain a friction wheel or flywheel, or use viscous fluid to control abrupt speed changes.

The brake system linkage could be replaced by a brake cable and pulleys to activate the tensioning shoe toward the belt. The braking system could also be built by compressing strips of the belt between two friction surfaces/shoes, or by stopping high friction surface rollers from turning that are guiding and supporting the continuous belt.

FIG. 3 also illustrates the mechanics involved with the preferred embodiment. Let $\mu$=the coefficient of friction between belt and track; let $\theta$=deflected angle of the belt (degrees), and let $\beta$=the degree of bend that the belt transitions (degrees). The elastic cords transmit their tensional forces "f" to the arms of length "D" and "d." Leverage multiples the force "f" by the ratio of D/d resulting in a larger force "F". This larger force "F" is transmitted to the belt. The right angle of the applied force "F" to the belt, and the small opposite angle which the belt deflects "$\theta$" induces a tension of "T". The tension "T" in the belt is approximately equal to "F/2 sin $\theta$". This tension creates a frictional resistance "R" between the belt and track approximately equal to "Te^($\mu$ $\beta$ ($\pi$/180))". Through these mechanical advantages we have a small force "f" controlling a larger one "W" the weight of the climber.

In operation, the climber 1 puts on the climbing harness 2, fastens the bottom of each elastic cord 3, and attaches the cords to the climbing harness. This stretches the elastic cords and activates the braking system. The climbing surface is now fixed and will not rotate until a certain climbing height is achieved. The climber grabs or steps on the climbing holds 4 of the continuous climbing wall and begins climbing. As the climber reaches a vertical height where the elastic cords are slack enough so that braking force on the belt 5 is less than the force of the climber's own weight, the belt moves down until the climber is lowered to a point where the elastic cords are again stretched and thus braking force is re-applied to the belt. This cycle is repeated for the duration of the climb.

Figure 4:
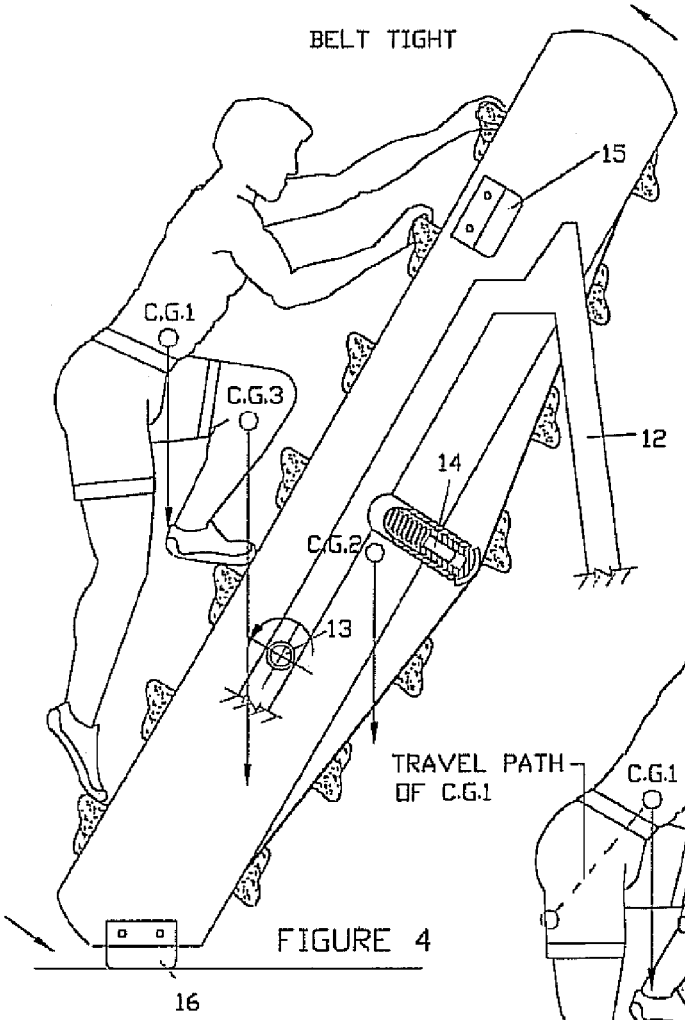
FIG. 4 is a side view of an alternative embodiment of the invention with the belt tensioned as a climber ascends.
Figure 5:
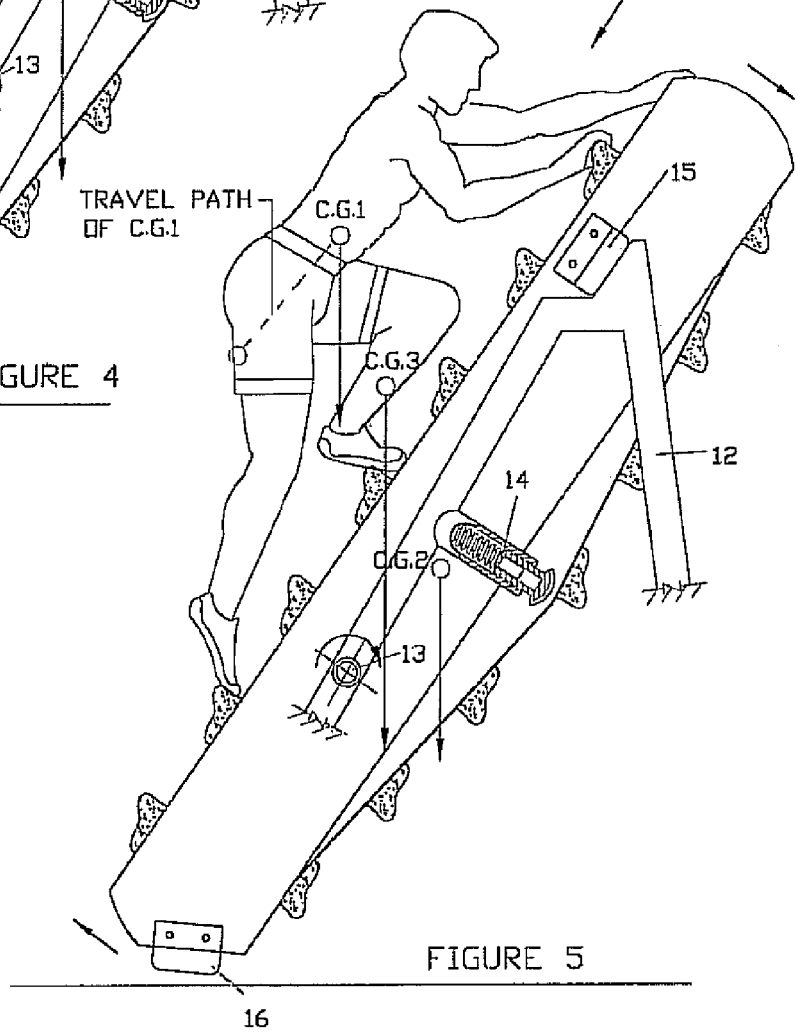
FIG. 5 is a side view of the alternative embodiment of FIG. 4 with the belt loosening as the climber reaches the upper portion of the belt.

FIGS. 4 and 5 illustrate an alternative embodiment of the invention, which utilizes the movement of the belt frame against a stationary frame to adjust belt tensioning, as opposed to user coupling. Rather, the position of the climber controls the brake system as the climber's center of gravity C.G.1 ascends up the surface. The body of the device (form and belt) is rotatable about the axis of 13 by virtue of a pivotal coupling to stationary frame 12.

As shown in FIG. 5, as the climber goes from the lower to the upper portion of the belt, the tilt frame over which the climbing belt rotates leans forward, allowing bumper 16 to be released from the ground, and bumper 15 to make contact with frame 12, limiting further movement. However, this also causes the tilt frame to move away from the shoe assembly 14, allowing the belt to loosen, causing the climber to move downwardly back to the configuration shown in FIG. 4. In that configuration, bumper 16 now rests against the ground, and tensioning shoe 14 is tighter against the inner surface of the belt, thereby discouraging slippage. The normal operation will be between these two points shown in FIGS. 4 and 5. Although a spring-loaded tensioning shoe is only shown in FIGS. 4 and 5, the tensioning shoe 7 of FIGS. 1-3 may also be spring-loaded. The spring tension may also be adjustable, for climber weight or other factors.

I claim:

1. A self-regulating endless climbing wall, comprising:

a form including upper and lower at least partially cylindrical outer surfaces, a planar forward surface, and an open back surface;

a rotating belt having an inner surface and an outer surface, the inner surface being disposed in sliding engagement with the cylindrical surfaces and planar forward surface of the form, the outer surface of the belt including a plurality of raised features configured for climbing by a user;

a tensioning shoe that engages with the inner surface of the belt through the open back surface of the form; and a mechanism, coupled to the tensioning shoe, operative to:

a) relieve tension on the belt as a user climbs upwardly, thereby increasing rotational slippage of the belt around the form, and b) increase tension on the belt as a user moves downwardly, thereby reducing or terminating rotational slippage of the belt around the form.

2. The climbing wall of claim 1, wherein the tensioning shoe is a generally horizontal bar having a lengthwise convex surface urged against the inner surface of the belt.

3. The climbing wall of claim 1, wherein the mechanism includes one or more lever arms coupled to a user.

4. The climbing wall of claim 1, wherein the mechanism includes one or more lever arms coupled to a user through a climbing harness.

5. The climbing wall of claim 1, further including:

a stationary frame;

a tilting form upon which the belt is disposed; and wherein the tensioning shoe is supported between the stationary frame and the tilting form such that the tension of the belt around the form is reduced as a user climbs upwardly and increased as a user moves downwardly.

6. A self-regulating endless climbing wall, comprising:

a form including upper and lower at least partially cylindrical outer surfaces, a planar forward surface, and an open back surface;

a rotating belt having an inner surface and an outer surface, the inner surface being disposed in sliding engagement with the cylindrical surfaces and planar forward surface of the form, the outer surface of the belt including a plurality of raised features configured for climbing by a user;

a pair of pivoting levers, each having one end coupled to a climber and a second end coupled to the tensioning shoe, whereby:

as a climber ascends the belt, the levers are raised, reducing the frictional engagement of the inner surface of the belt against the form, and as a climber moves downwardly on the belt, the levers are lowered, increasing the frictional engagement of the inner surface of the belt against the form.

7. The climbing wall of claim 6, wherein the tensioning shoe is a generally horizontal bar having a lengthwise convex surface urged against the inner surface of the belt.

8. The climbing wall of claim 6, wherein the lever arms are coupled to a user through a climbing harness.

* * * * *